US005893432A

United States Patent [19]

Nguyen et al.

[11] Patent Number: 5,893,432

[45] Date of Patent: Apr. 13, 1999

[54] CONTROLLED EMERGENCY STOP APPARATUS FOR ELEVATORS

[75] Inventors: Tac H. Nguyen, Flanders; Julio C. Ramos, Dover, both of N.J.

[73] Assignee: Inventio AG, Hergiswil, Switzerland

[21] Appl. No.: 08/777,904

[22] Filed: Dec. 31, 1996

[51] Int. Cl.[6] ..... B66B 1/06

[52] U.S. Cl. ..... 187/290

[58] Field of Search ..... 187/290, 297

[56] References Cited

U.S. PATENT DOCUMENTS

| | | | |
|---|---|---|---|
| 4,434,873 | 3/1984 | Ohta et al. | 187/28 |
| 5,058,710 | 10/1991 | Iwasa | 187/290 |
| 5,285,029 | 2/1994 | Araki | 187/290 |

FOREIGN PATENT DOCUMENTS

| | | | |
|---|---|---|---|
| 0 630 847 A2 | 12/1994 | European Pat. Off. | B66B 5/02 |
| 0 703 182 A2 | 3/1996 | European Pat. Off. | B66B 5/02 |
| 58-207893 | 12/1983 | Japan . | |
| 2-33076 | 2/1990 | Japan | 187/290 |
| 2034079 | 5/1980 | United Kingdom . | |
| 2068663 | 8/1981 | United Kingdom . | |
| 2105128 | 3/1983 | United Kingdom . | |
| 2121557 | 12/1983 | United Kingdom . | |
| 2 256 100 | 11/1992 | United Kingdom | B66B 5/02 |
| 2017346 | 10/1997 | United Kingdom . | |

*Primary Examiner*—Robert E. Nappi

*Attorney, Agent, or Firm*—MacMillan,Sobanski & Todd, LLC

[57] ABSTRACT

An apparatus for controlling an emergency stop of an elevator car 11 is connected in an elevator system 10 including a drive motor 15 coupled to the car, a drive control 18 connected between the drive motor and an AC electrical power source 17 for operating the drive motor and an elevator control 19 connected to the drive control for controlling starting, running and stopping of the elevator car. A controlled emergency stop circuit 21 has a battery supply 28 connected to receive and store electrical power from the power source 17 and is connected to provide electrical power to the elevator control 19. A normally open switch 33,34,36,37 is connected between the battery supply 28 and the drive control 18. A controller is connected to the switch and receives a power failure signal representing a loss of electrical power at the drive control 18. The controller responds to the power failure signal by closing the switch to connect the battery supply 28 to the drive control 18 to supply electrical power to the drive means and the elevator control 19 which controls an emergency stop of the elevator car 11 at a predetermined deceleration rate.

9 Claims, 4 Drawing Sheets

CONTROLLED EMERGENCY STOP APPARATUS FOR ELEVATORS

BACKGROUND OF THE INVENTION

The present invention relates generally to elevator controls and, in particular, to an apparatus for controlling an emergency stop of an elevator.

Present day elevator systems perform an emergency stop during certain failure conditions such as loss of incoming power, safety circuit failure, etc. This type of stop involves the removal of power from the drive system and the application of the mechanical brake. Since the brake sets with a predefined force (sufficient to hold 150% of the maximum load) the car deceleration varies widely as a function of the actual load in the car during the emergency stop. Thus, passengers could be subjected to discomfort and potential injury during harsh emergency elevator stops.

SUMMARY OF THE INVENTION

The present invention concerns an apparatus for controlling an emergency stop of an elevator car in an elevator system. The elevator system includes a drive motor coupled to the elevator car, a drive control connected between the drive motor and an AC electrical power source for operating the drive motor, and an elevator control connected to the drive control for controlling starting, running and stopping of the elevator car. A controlled emergency stop circuit means has a power input connected to the AC electrical power source, a controller power output connected to supply electrical power to the elevator control and a drive control power output connected to supply electrical power to the drive control. A DC electrical power storage means is connected to the power input for receiving and storing electrical power from the AC electrical power source and is connected to the controller power output for providing electrical power to the elevator control. A normally open switch means is connected between the DC electrical power storage means and the drive control power output; and a control means is connected to the switch means and has an input for receiving a power failure signal representing a loss of electrical power at the drive control. The control means responds to the power failure signal by closing the switch means to connect the DC electrical power storage means to the drive control, the DC electrical power storage means supplying electrical power to the drive means and the elevator control controlling an emergency stop of the elevator car coupled to the drive motor at a predetermined deceleration rate.

When the drive motor is an AC motor, the drive control includes an inverter having an output connected to the AC motor and an input. A bridge and a DC link are connected in series between the AC electrical power source and the inverter input, and the switch means is connected between the DC electrical power storage means and the inverter input. When the drive motor is a DC motor, the drive control includes an armature output and a field output connected to the DC motor, and the switch means connects the armature output to an armature of the DC motor and connects the field output to a field of the motor in the normally open position and connects the DC electrical power storage means to the DC motor armature and field in the closed position.

It is an object of the present invention to emergency stop a fully loaded elevator car within a predetermined slide distance and to emergency stop an empty elevator car at a similar deceleration rate.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
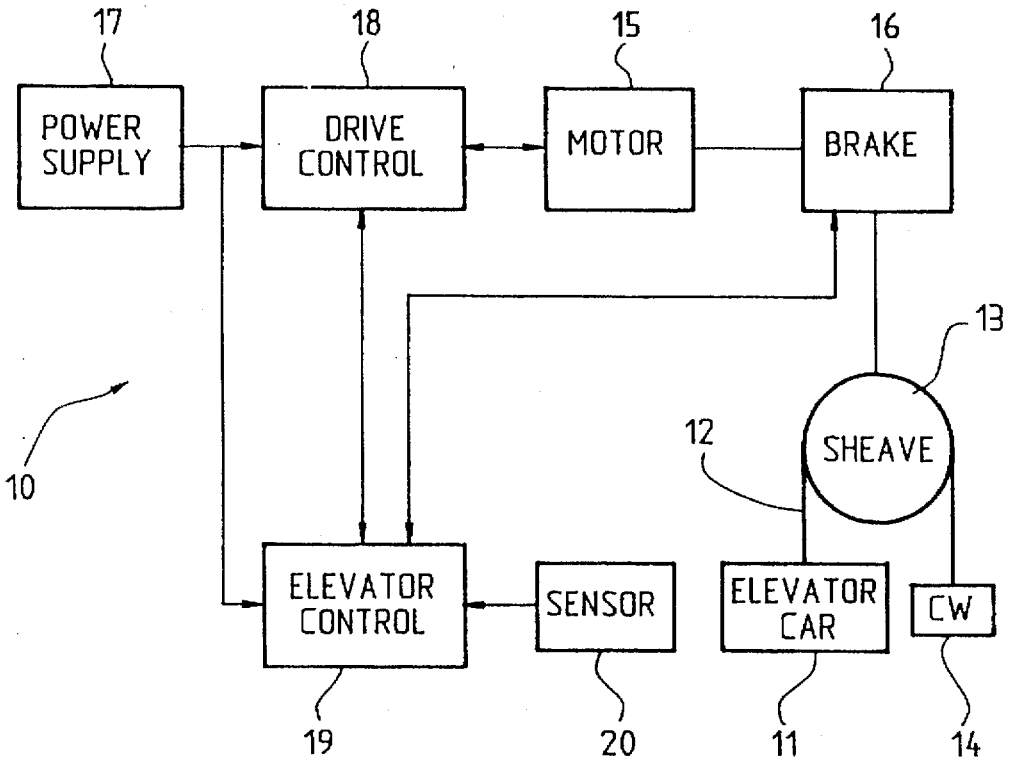
Fig. 1 (PRIOR ART)
FIG. 1 is a schematic block diagram of a prior art elevator system.

There is shown in the FIG. 1 a prior art elevator system 10 including an elevator car 11 mounted for movement in an elevator shaft (not shown) to serve various floors of a building. The car 11 is supported from one end of a cable 12 which extends over a sheave 13 rotatably mounted at an upper end of the shaft. The weight of the car 11 and a portion of a full load of passengers is balanced by a counterweight CW 14 attached to an opposite end of the cable 12. A drive means, such as a motor 15, is coupled to the sheave 13 in a conventional manner through a brake 16 for moving the car 11 up and down the shaft. A power supply 17 is connected through a drive control 18 to supply electrical power to the motor 15. Depending upon the system requirements and whether the motor 15 is AC or DC, the power supply 17 can be as simple as AC power input lines. An elevator control means 19 is connected to the power supply 17 to receive operating power. The control means 19 also is connected to the drive control 18 and to the brake 16 to control the speed of the motor 15 thereby controlling the starting, stopping and speed of movement of the car 11. The elevator control 19 also is connected to a sensor 20 which generates a signal representing an emergency condition that requires the car 11 to be stopped by actuating the brake 16 to apply a predetermined holding force.

The elevator control system 10 shown in the FIG. 1, which derives the power for the circuits in the drive control 18 and the elevator control 19 from the input lines, does not have any provisions for motor control once the input power is removed, such as the result of a power failure. During emergency shutdowns on DC systems, contactors connect a resistor assembly across the DC motor armature and shunt current into the field coil to provide a decelerating torque from the motor. The system 10 suffers from variations in deceleration rates depending on car load. For AC induction motors which require time varying fields for torque production this simple solution is inadequate.

Figure 2:
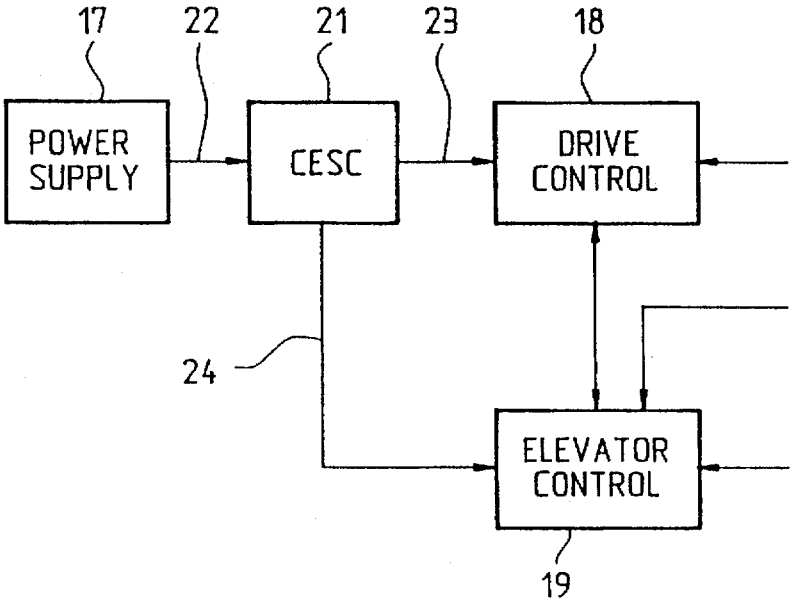
FIG. 2 is a schematic block diagram of a portion of the elevator system show in the FIG. 1 including an emergency stop apparatus in accordance with the present invention.

There is shown in the FIG. 2, a portion of the elevator system 10 including an emergency stop apparatus 21 in accordance with the present invention. The apparatus 21 is a controlled emergency stop circuit (CESC) system which has an input connected to an output of the power supply 17 by AC power lines 22, an output connected to a power input of the drive control 18 by first power lines 23 and a plurality of inputs and outputs connected to a plurality of outputs and inputs of the elevator control 19 by lines 24. As described below, the CESC system 21 includes a simple high voltage battery supply (or lower voltage batteries and voltage doubling circuits) which is maintained charged by the building supply lines. All power to the circuits in the drive control 18 and the elevator control 19 is sourced from this supply such that upon removal of the main line, the control electronics are still powered.

When an emergency shutdown condition occurs, the system 10 drops the brake 16 and the drive control (powered either from the main line, or from the battery supply if necessary) attempts to decelerate the car 11 at a predefined rate. Since the control 18 is fully powered, the speed loop feedback system is operational and the drive has closed loop control over car speed. This enables the system to drive against the brake (under light car load conditions) to soften the deceleration or with the stopping force of the brake to minimize the slide of an over/heavily loaded car. Configured for a DC system, the CESC system 21 applies DC voltage/current directly to the motor armature/field to regulate the speed of the system. For AC systems, the CESC system 21 has the simpler task of providing a DC link of the system and allowing the three phase inverter section to regulate the AC motor currents required for speed control.

Note that since the brake 16 is (ideally) set to hold a percentage of capacity, an emergency shutdown caused by the drive subsystem results in the fail safe setting of the brake without activation of the drive system.

Figure 3:
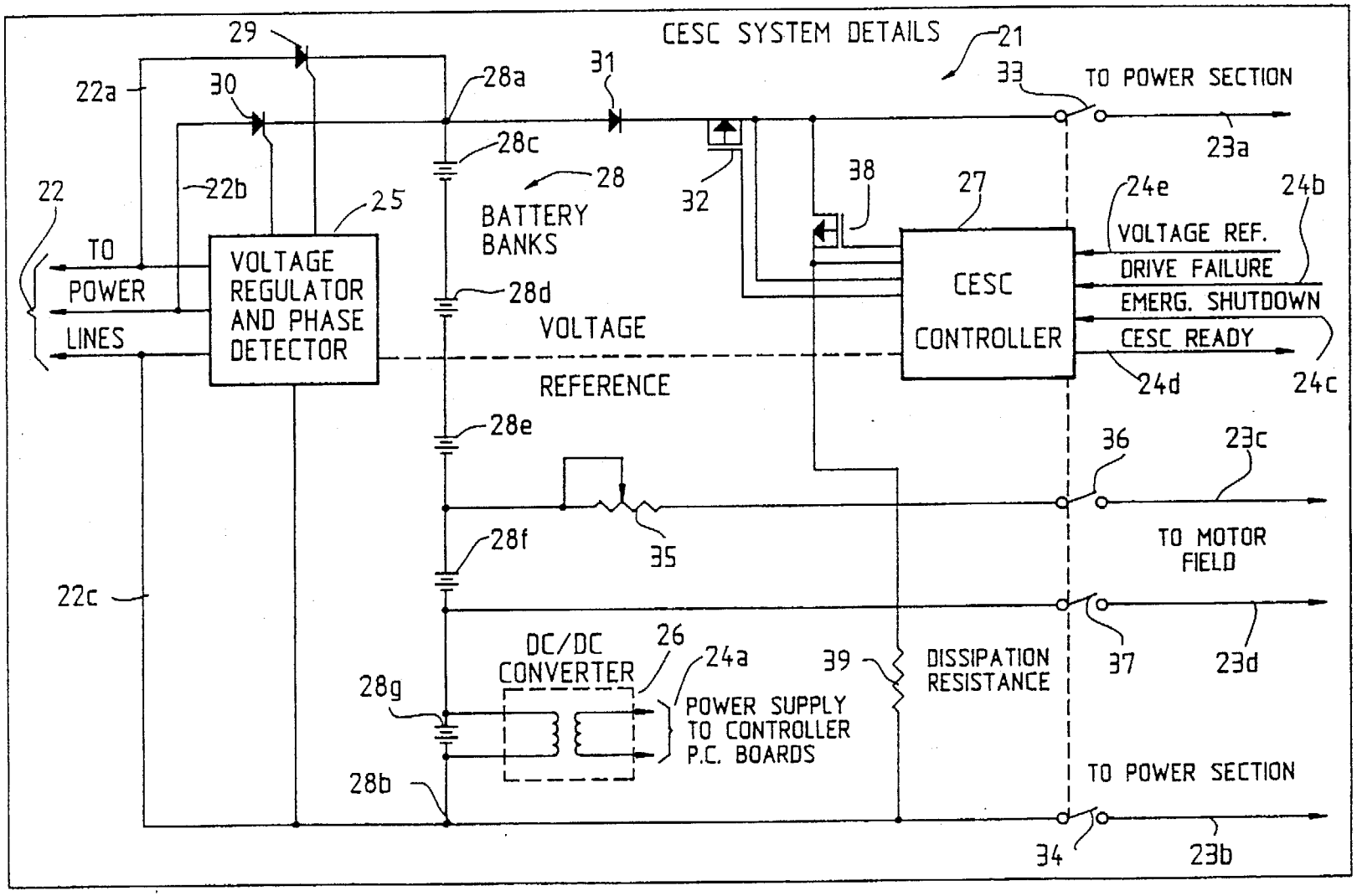
FIG. 3 is schematic of the emergency stop apparatus shown in the FIG. 2.

The CESC system 21 is shown in more detail in the FIG. 3 schematic block diagram. The CESC system 21 includes a voltage regulator and phase detector module 25, a DC-to-DC converter supply 26, a controller unit 27 and a charge storage bank 28. The voltage regulator and phase detector module 25 has three inputs each connected to an associated one of the three AC power lines 22 to monitor the status of the incoming power lines and to maintain the charge storage bank 28 ready for use. A first AC power line **22*a* is connected through a first SCR 29 to a positive potential terminal 28*a* of the charge storage bank 28. A second AC power line 22*b* also is connected through a second SCR 30 to the positive potential terminal 28*a*. Each of the SCRs 29 and 30 has a gate connected to an associated one of a pair of firing signal outputs of the module 25. A third AC power line 22*c* is connected to another input of the unit 25 and to a negative potential terminal 28*b* of the charge storage bank 28. The bank 28 can be formed by a plurality of batteries 28*c* through 28*g* with an input of the DC-to-DC converter supply 26 connected across the battery 28*g* connected to the terminal 28*b*. An output of the supply 26 is connected to a pair of power supply lines 24*a* of the lines 24 to provide electrical power to the electronics in the elevator control 19**.

The positive potential terminal **28*a* of the CESC 21 is connected through a diode 31, a first FET 32 and a first switch 33 in series to a power section of the drive control 18 by a first one of the power lines 23*a*. The negative potential terminal 28*b* of the CESC 21 is connected through a second switch 34 to the power section of the drive control 18 by a second one of the power lines 23*b*. A junction between the batteries 28*e* and 28*f* is connected through a potentiometer 35 and a third switch 36 in series to a field of the motor 15 by a third one of the power lines 23*c*. A junction between the battery 28*f* and the battery 28*g* is connected through a fourth switch 37 to the field of the motor 15 by a fourth one of the power lines 23*d***.

The control unit 27 has an output connected to a gate of the first FET 32 and an input connected to the junction of the first FET and the first switch 33. A second FET 38 is connected in series with a resistor 39 between the junction of the first FET 32 and the first switch 33 and the terminal **28*b*. The control unit 27 has another output connected to a gate of the second FET 38 and an input connected to the junction of the second FET and the resistor 39. The control unit 27 is coupled to actuate the switches 33, 34, 36 and 37. The control unit 27 interfaces with the elevator control 19 to monitor a status of a drive failure signal on a line 24*b*, to monitor a status of an emergency shutdown control signal on a line 24*c*, to generate a CESC ready status signal on a line 24*d*, as well as to monitor a speed/voltage reference signal on a line 24*e*** for DC motor applications.

Figure 4:
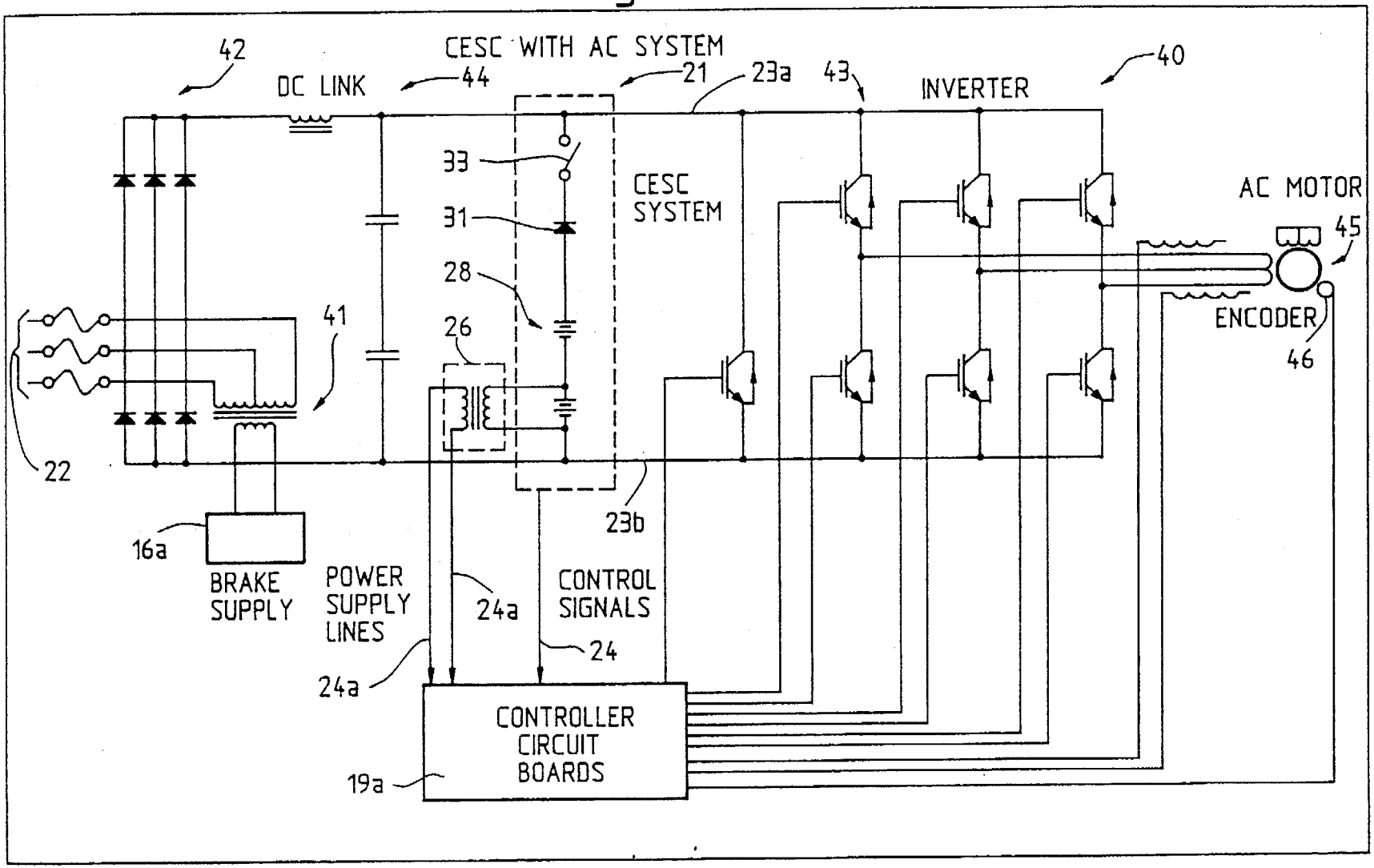
FIG. 4 is schematic of the emergency stop apparatus shown in the FIG. 3 incorporated in a typical nonregenerative AC inverter elevator drive system.

There is shown in the FIG. 4 the CESC system 21 added to a typical nonregenerative AC inverter elevator drive system 40. The AC power lines 22 are connected to a transformer 41 to provide power to an electromagnetic brake supply **16*a* and are connected to an input of a full wave bridge 42 to generate DC power. An output of the bridge 42 is connected to an input of an inverter 43 by a DC link 44 which includes a choke and capacitors. The inverter 43 has an output connected to an AC motor 45. A set of controller circuit boards 19*a* represents the electronics in the elevator control 19 which are connected to control the operation of the inverter 43 and control windings of the motor 45. An encoder 46 is connected to the circuit boards 19*a* to provide a speed signal representing the speed of the motor 45. The CESC system 21 is connected across the output of the bridge 42**.

Upon detection of a failure condition in which the elevator control 19 is still functional but an emergency stop is required, the elevator control simply uses its existing software and speed loop control to ramp down the speed of the motor 45 at a fixed deceleration rate. The servo will in this way drive against or aid the mechanical brake in the deceleration of the car 11 at a rate unlikely to cause physical damage to the passengers. The CESC system 21 in this configuration ensures that the elevator control 19 and drive control 18 remain powered and functioning regardless of the failure of the main line supply 17 connected to the power lines 22 (brown out, black out, loss of phase, etc.). If a problem with the supply voltage is detected, the CESC system 21 connects itself to the DC link 44 thus supplying the required DC power to the inverter power electronics 43 for AC motor control. This switching of power sources is transparent to the elevator control 19 and the drive control 18 and thus both can be used essentially without modification. The dissipative resistance bank 39 shown in the FIG. 3 is not necessary since the drive system has its own power dissipation means. Also, the motor field supply connections, the potentiometer 35, the switches 36 and 37 and the lines **23*c* and 23*d*, are not required for the AC motor 45**.

Figure 5:
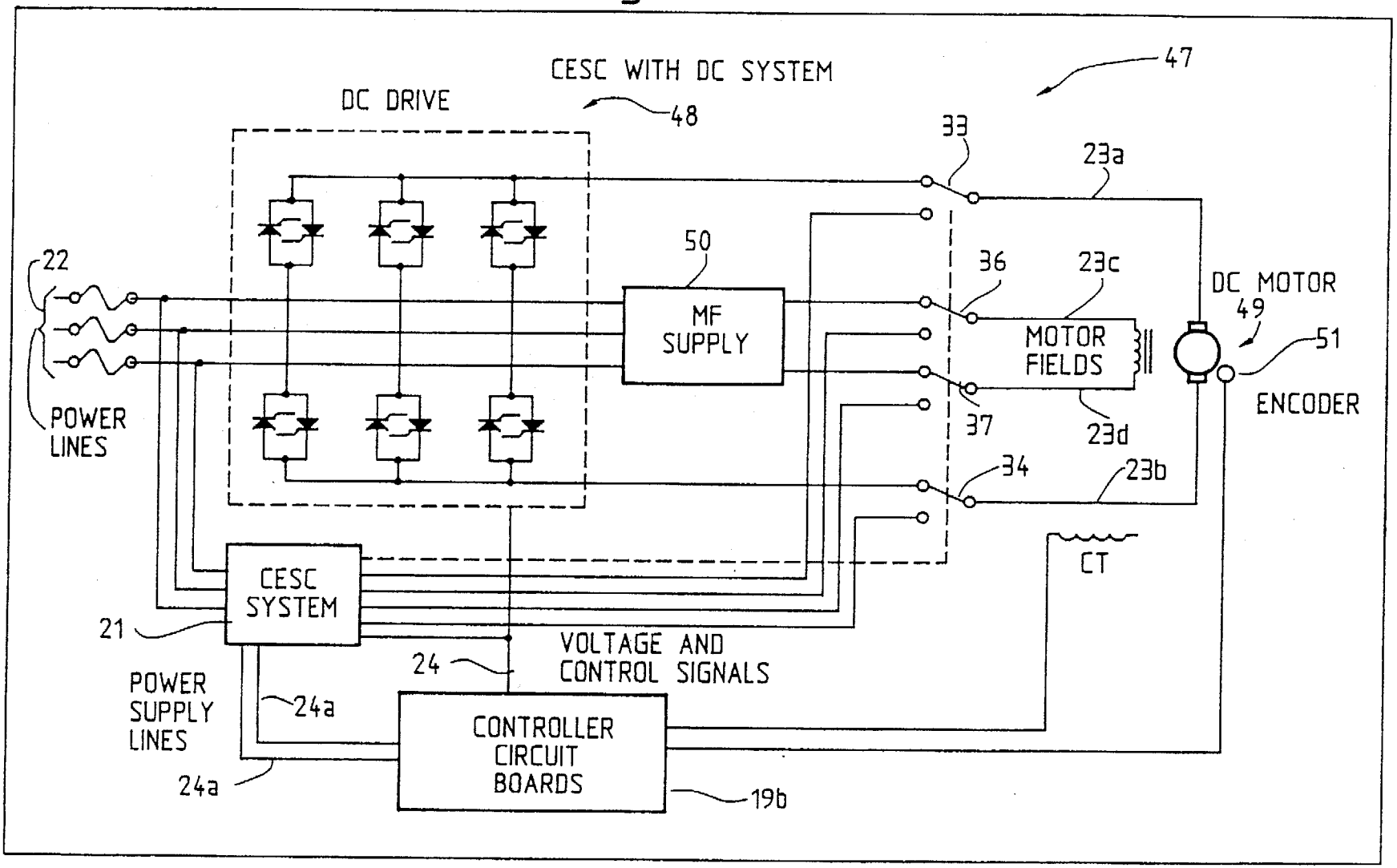
FIG. 5 is schematic of the emergency stop apparatus shown in the FIG. 3 incorporated in a typical DC elevator drive system.

There is shown in the FIG. 5 the CESC system 21 connected to a typical DC drive system 47. The AC power lines 22 are connected to an input of a DC drive 48 and the CESC system 21. An output from the DC drive 48 is connected through the switches 33 and 34 to an armature winding of a DC motor 49. The AC power lines 22 also are connected to an input of a motor field MF supply 50 having an output connected through the switches 36 and 37 to a motor field winding of the motor 49. An encoder 51 is connected to a set of controller circuit boards **19*b* to provide a speed signal representing the speed of the motor 49. The set of controller circuit boards 19*b* represents the electronics in the elevator control 19 which are connected to control the operation of the DC drive 48 and control windings of the motor 49. An external potentiometer (potentiometer 35 shown in the FIG. 3) is connected to terminals provided on the CESC system 21 for the DC motor field supply. In addition, a dissipation resistor network (resistor 39 shown in the FIG. 3) is connected to the CESC system 21** for dissipation of regenerative power on regenerative systems.

For a DC system, the resistors that were previously used to shunt across the DC motor armature under emergency stop conditions are now connected to the CESC system 21 to provide the required controlled motor voltages. In normal operation, the CESC system 21 functions only to provide power to all the circuit boards **19*b* and to maintain the correct charge on the internal battery bank. During emergency stop conditions in which regenerative energy is sourced from the motor 49, the CESC system 21 pulses this power into the dissipation resistance bank so as to control the motor voltage/speed. During emergency stop conditions in which power must be sourced from the drive 48, the CESC controller pulses energy from the battery banks to accomplish the required velocity control. Since the control boards 19*b* remain powered by the CESC system 21 even if the line voltage is removed, the drive servo continues to track car velocity and provide a voltage reference to the system. Under normal conditions this reference is fed to the DC drive 48, but under failure conditions the CESC system 21** uses this same signal to take over for the DC drive system.

In summary, the apparatus for controlling an emergency stop of the elevator car 11 in the elevator system 10 includes: the drive motor 15 coupled to the elevator car; the drive control 18 connected between the drive motor and the AC electrical power source 17 for operating the drive motor; the elevator control 19 connected to the drive control for controlling starting, running and stopping of the elevator car; the circuit means 21 having the power input connected to the AC electrical power source, the controller power output connected to supply electrical power to the elevator control and the drive control power output connected to supply electrical power to the drive control; the DC electrical power storage means 28 connected to the power input for receiving and storing electrical power from the AC electrical power source and connected to the controller power output for providing electrical power to the elevator control; the normally open switch means 33,34,36,37 connected between the DC electrical power storage means and the drive control power output; and the control means 27 connected to the switch means and having an input for receiving a power failure signal representing a loss of electrical power at the drive control, the control means responding to the power failure signal by closing the switch means to connect the DC electrical power storage means to the drive control, the DC electrical power storage means supplying electrical power to the drive means and the elevator control controlling an emergency stop of the elevator car coupled to the drive motor at a predetermined deceleration rate.

When the drive motor 15 is an AC motor, the drive control 18 includes the inverter 43 having an output connected to the AC motor and an input. The bridge 42 and the DC link 44 are connected in series between the AC electrical power source 17 and the inverter input, and the switch means 33 is connected between the DC electrical power storage means and the inverter input. When the drive motor 15 is a DC motor, the drive control 18 includes an armature output and a field output connected to the DC motor, and the switch means 33,34,36,37 connects the armature output to an armature of the DC motor and connects the field output to a field of the motor in the normally open position and connects the DC electrical power storage means 28 to the DC motor armature and field in the closed position.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for controlling an emergency stop of an elevator car in an elevator system, the elevator system including a DC drive motor coupled to the elevator car, a drive control connected between the DC drive motor and an electrical power supply, and an elevator control connected to the electrical power supply and to the drive control for controlling starting, running and stopping of the elevator car, the apparatus comprising:

a controlled emergency stop circuit (CESC) means having a power input adapted to be connected to an electrical power supply, an emergency elevator control power output adapted to be connected to an elevator control and an emergency drive control power output adapted to be connected to a DC drive motor;

a sensor means in said CESC means connected to said power input for generating a reference signal representing a status of an electrical power supply connected to said power input;

a DC electrical power storage means connected to said power input for receiving and storing electrical power from an electrical power supply connected to said power input;

a control means connected to said sensor means for receiving said reference signal; and a switch means connected to said emergency drive control power output and adapted to be connected between the DC drive means and the drive control where by when input power is connected to the electrical power supply, said power output is connected to the elevator control, said control means responds to said reference signal representing normal operation of the electrical power supply to actuate said switch means to connect the drive control to the DC drive motor and, upon a failure of the electrical power supply, said control means responds to said reference signal to actuate said switch means to disconnect the drive control and connect said DC electrical power storage means to provide power to the DC drive motor, said DC electrical power storage means also supplying electrical power to the elevator control for controlling an emergency stop of an elevator car coupled to the drive motor at a predetermined deceleration rate.

2. The apparatus according to claim 1 wherein said control means includes an input for receiving a failure signal from the elevator control representing a failure of the drive control and said control means responds to said failure signal to actuate said switch means to disconnect the drive control and connect said DC electrical power storage means to the DC drive motor.

3. An apparatus for controlling an emergency stop of an elevator car in an elevator system comprising:

a DC drive motor coupled to an elevator car;

a drive control connected between said DC drive motor and an AC electrical power supply for operating said DC drive motor;

an elevator control connected to said drive control for controlling starting, running and stopping of said elevator car;

a controlled emergency stop circuit (CESC) means having a power input connected to said AC electrical power supply, an emergency elevator control power output connected to supply electrical power to said elevator control and an emergency a drive control power output for supplying electrical power to said DC drive motor;

a DC electrical power storage means connected to said power input for receiving and storing electrical power from said AC electrical power supply and connected to said emergency elevator control power output for providing electrical power to said elevator control;

a normally open switch means connected between said emergency drive control power output and said DC drive motor; and a control means connected to said switch means and having an input for receiving a failure signal representing an emergency stop condition for the elevator car, said control means responding to said failure signal by closing said switch means to connect said DC electrical power storage means to said DC drive motor and disconnect said drive control from said DC drive motor, said control means regulating the supply of electrical power from said DC electrical power storage means to said DC drive motor for controlling an emergency stop of the elevator car coupled to said DC drive motor at a predetermined deceleration rate.

4. The apparatus according to claim 3 wherein said control means includes an input for receiving a failure signal representing at least one of a drive failure signal, an emergency shutdown signal and a voltage reference signal.

5. The apparatus according to claim 3 including a sensor connected to said control means for generating said voltage reference signal representing a speed of said DC drive motor, said control means responding to said voltage reference signal for regulating the supply of electrical power to said DC drive motor.

6. The apparatus according to claim 3 wherein said DC electrical power storage means is a battery supply.

7. The apparatus according to claim 3 wherein said DC electrical power storage means includes a DC-to-DC converter having an output connected to said controller power output.

8. The apparatus according to claim 3 wherein said drive control includes an armature output and a field output connected to said DC drive motor, and said switch means connects said armature output to an armature of said DC drive motor and connects said field output to a field of said motor in said normally open position and connects said DC electrical power storage means to said DC drive motor armature and field in said closed position.

9. The apparatus according to claim 8 including a potentiometer connected between said DC electrical power storage means and said DC drive motor field.

* * * * *